US005933976A

United States Patent [19]

Pressutti et al.

[11] Patent Number: 5,933,976

[45] Date of Patent: Aug. 10, 1999

[54] METHOD OF INSTALLING A RIDGE COVER AND GUIDE TOOL FOR PRACTICING THIS METHOD

[76] Inventors: Joseph E. Pressutti, 2525 W. Sierra Ave., Fresno, Calif. 93711; Ken L. Gunier, 4083 N. Peach, No. 227, Fresno, Calif. 93727

[21] Appl. No.: 08/866,559

[22] Filed: May 30, 1997

[51] Int. Cl.[6] ..... G01D 21/00

[52] U.S. Cl. ..... 33/648; 33/647

[58] Field of Search ..... 33/649, 648, 647, 33/646, 613, 645; 52/518

[56] References Cited

U.S. PATENT DOCUMENTS 3,913,294 10/1975 Freiborg ..... 52/518
5,365,711 11/1994 Pressutti et al. ..... 52/518

*Primary Examiner*—Bernard Roskoski
*Attorney, Agent, or Firm*—Terry L. Miller

[57] ABSTRACT

A guide tool allows ridge covers to be installed on a ridge, hip, or rake of a roof with a uniform overlap of adjacent ridge covers. Consequently, a uniform shadow effect is achieved by adjacent ridge covers all along the ridge, hip, or rake of the roof, and the appearance of the roof is improved. A method of using this tool in applying ridge covers on a roof is presented also.

14 Claims, 3 Drawing Sheets

FIG. 5.
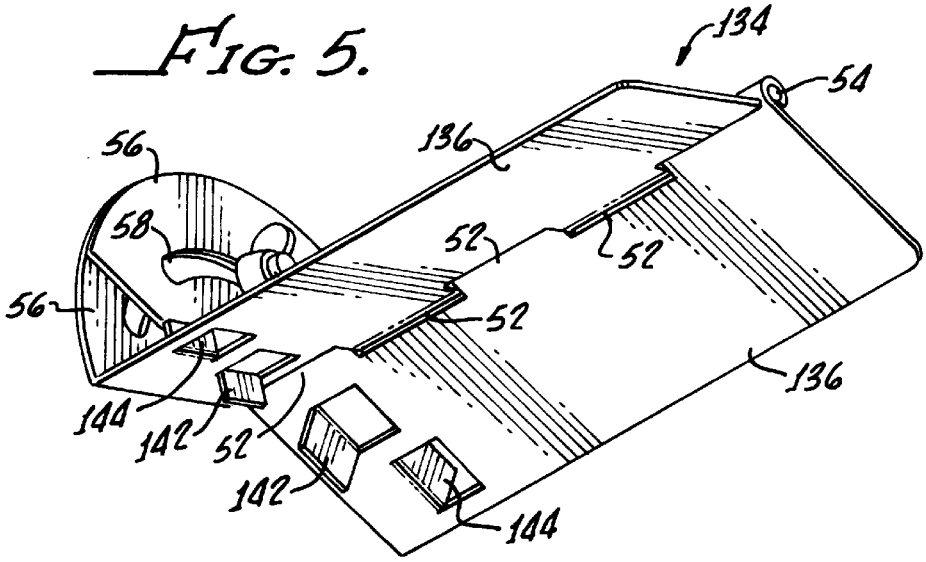
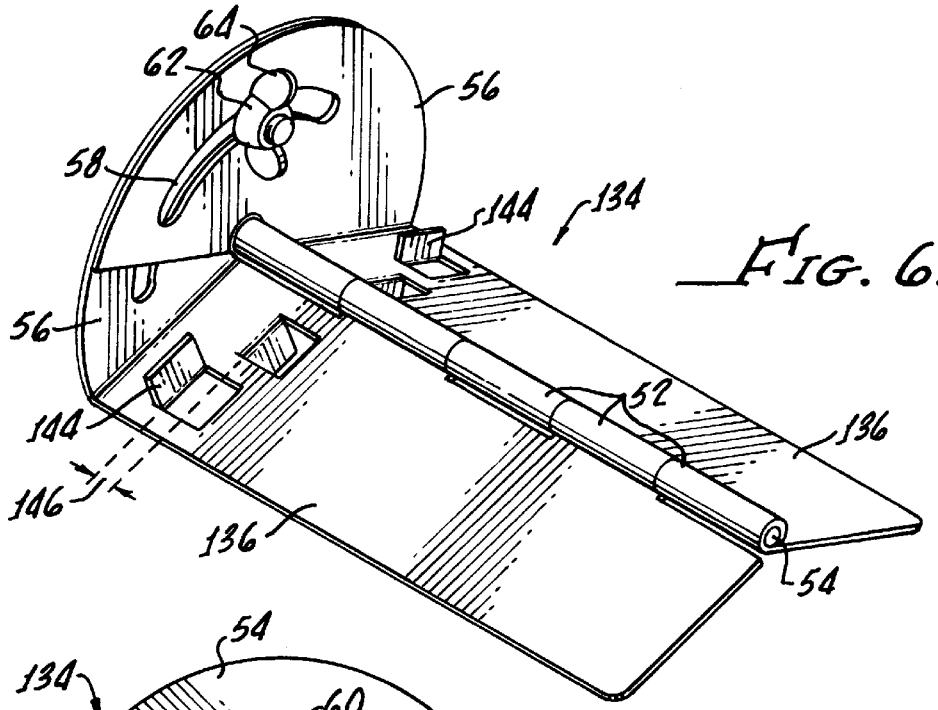
FIG. 6.
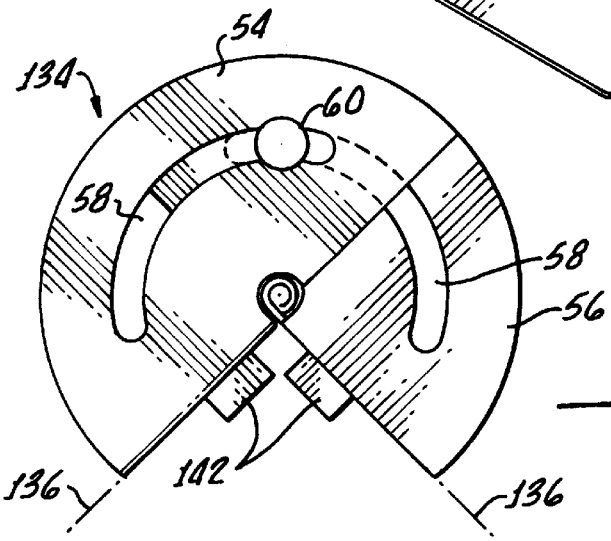
FIG. 7.

METHOD OF INSTALLING A RIDGE COVER AND GUIDE TOOL FOR PRACTICING THIS METHOD

BACKGROUND OF THE INVENTION

1. Field of the Invention

The present invention relates to a method of installing a ridge cover on a roof, for example, on the hips, ridges, or rakes of the roof. Such a ridge cover is be a low-cost, durable and highly aesthetic shingle product which is installed at the ridges, hips, and rakes of a roof where planar sections of the roof surface intersect. When properly installed, in addition to providing excellent weather protection, the ridge covers cooperatively give the ridges, hips, or rakes somewhat an appearance of depth like that of a shake roof. A part of this appearance of depth arises from the actual thickness of the ridge covers, which in a central part of the ridge covers may be several times the thickness of asphalt composition shingles. Another part of this appearance of depth is created by shadow lines cast by the ridge covers upon adjacent ridge covers. This appearance of depth can give a roof a more pleasing appearance even though the planar portions of the roof are covered with conventional asphalt shingles which do not have such an appearance of depth.

More particularly, the present invention relates to a method of consistently and repeatably installing such ridge covers in a selected position relative to one another so that in cooperation the shadow lines created on adjacent ridge covers are consistent and the aesthetic appearance of the roof is improved. At the same time, this uniformity of relative position at installation improves the weather protection provided by the ridge covers. Still more particularly, the present invention relates to a guide tool for use in practicing the method. The guide tool may be used by a roofer in installing the ridge covers on a roof in order to eliminate previous error-prone installation methods. These conventional and error-prone installation methods include the labor-intensive individual measuring of the position of each ridge cover relative to an adjacent ridge cover, and the visual judging of this relative position based on experience and judgment.

2. Description of Related Art

A conventional low-cost organic asphalt composition ridge cover is known in accord with U.S. Pat. No. 3,913,294, issued Oct. 21, 1975 to B. Freiborg. A problem with the Freiborg ridge cover is its low fire resistance rating, and relative fragility, especially during installation. During installation of such ridge covers, the installer opens the ridge cover from a folded position to a position matching the angulation of the intersecting planar portions of a roof, at a ridge, hip, or rake. The ridge covers are then nailed in place conventionally. However, during this bending open of the ridge covers preparatory to installation the Freiborg ridge covers have been known to fracture through so that they are no longer usable.

An improved asphalt composition ridge cover is also known in accord with U.S. Pat. No. 5,365,711, issued Nov. 22, 1994 to Joseph E. Pressutti, et al (hereinafter, the '711 patent). In contrast to the teachings of the conventional thinking in the field of roofing materials, the '711 patent teaches to make a ridge cover structurally similar to that taught by the Freiborg '294 patent, but which is formed of a base of fiberglass mat or felt with a fill-coat of impregnating asphaltic material especially modified to make it less brittle. The modified asphaltic material may be considered somewhat rubbery in comparison to the rather brittle asphaltic materials used by Freiborg, for example, especially at cooler temperatures. The fiberglass felt and asphaltic material are combined in such a way as to provide a composition structure of inorganic glass fibers in an asphaltic matrix which is uniform substantially through the thickness of the ridge cover.

This construction of ridge cover surprisingly has been discovered to tolerate sharp back bending at least as well as or even better than the old organic asphalt composition material. It is believed that the modified asphaltic material impregnating into the mat of glass fibers surrounds and supports these fibers such that the mat will tolerate sharp bending. The matrix of modified asphaltic material, rather than itself being brittle, is somewhat rubbery and may distribute bending forces in the composite structure of the shingle rather than itself fracturing and concentrating bending forces on the glass fibers. An outer coating of granular mineral material is adhered to the base with an additional layer of the modified asphaltic material.

Despite the shortcomings outlined above, the ridge cover according to the Freiborg patent has been a commercially successful product for many years. However, during this time, inorganic composition roofing materials have been developed which are considerably more flexible, durable and fire resistant than the conventional asphalt composition roofing materials of organic felt layered with asphalt and mineral granules. Specifically, these improved modern roofing materials include a sheet-like mat or felt of inorganic glass fibers with a layer of coating-grade asphaltic material partially impregnating the inorganic felt. The fire-resistance rating of these field shingles is much better than could be provided by the Freiborg ridge cover. Accordingly, the more recent Pressutti ridge cover provides a fiberglass composition ridge cover with a fire rating as good as the modern field shingles. Additionally, the Pressutti ridge cover is easier to apply, and suffers little or no damage during the installation process, in contrast to the damage-prone Freiborg ridge cover.

Again, it will be appreciated that during installation of ridge covers according to either the Freiborg or Pressutti patent referenced above, the installer removes the ridge covers from a shipping box, within which the ridge covers are in a folded closed position, somewhat like the pages of a closed book. From this position, the installer opens the ridge covers, somewhat like opening a book, and lays them sequentially atop the ridge, hip, or rake of the roof on which they are nailed. The installer starts at the lower end of a hip or rake, or at one end of a ridge, and installs the ridge covers upwardly toward the peak of the roof, or along the ridge from end to end. Conventionally, roofers use a notch formed on shingles or ridge covers to simply "eye ball" a correct position for the roofing products relative to one another as each successive shingle or ridge cover is nailed in place. Frequently, the relative positioning of roofing products is acceptable if they are within ±¼ inch of a desired relative position, and roofers are used to working with this relatively lax positional accuracy requirement. However, ridge covers of the type at hand may have an overlap dimension of only ¼ inch. In other words, a variation of relative position of only ⅛ inch can be half of the desired overlap, and is very significant in the installation of these ridge covers. Yet this accuracy requirement is twice as severe as roofers are used to working with.

Thus, some roofers may use a measuring stick or ruler in an attempt to obtain better positional uniformity when installing ridge covers, but still rely only on sight to place the ridge covers. Considering the pace at which such installations are carried out, especially with the use of power nail guns, it is not surprising that some of the ridge covers are frequently installed with an improper or non-uniform overlap, and resulting improper or non-uniform shadow lines on the roof.

To repeat, an important consideration in achieving an attractive appearance for a roof by use of ridge covers according to the Freiborg or Pressutti teaching is the correct spacing and uniformity of this correct spacing from one ridge cover to the next along a ridge, hip, or rake of the roof. As mentioned above, when properly installed on a roof, these ridge covers cooperatively give the ridges, hips, or rakes somewhat an appearance of depth like that of a shake roof. Part of this appearance of depth arises from an actual thickened portion of the ridge covers. And another part of this appearance of depth arises from shadow lines cast by an overhanging portion of each ridge cover upon an adjacent ridge cover. This appearance of depth can give a roof a more pleasing appearance even though the planar portions of the roof are covered with conventional asphalt shingles which do not have such an appearance of depth.

A critical aspect of this shadow-line depth appearance of the ridge covers as installed is the achievement of a uniform and proper overlap of each ridge cover along a ridge or up a hip or rake over the adjacent or next lower ridge cover. Dependent upon the position of the sun in the sky, the shadows cast by the ridge covers on one another can give a uniform and pleasing appearance to properly installed ridge covers, or can reveal the inconsistencies of improperly installed ridge covers. In the case of improperly installed ridge covers, some of the shadow lines may not be deep enough to conceal the thickened portion of the underlying or next adjacent ridge cover. Thus, a person on the ground who is viewing the roof will see a non-uniformity of the shadow lines along a ridge, hip, or rake, and may even see some of the thickened portions of the ridge covers which are illuminated by ambient light rather than being in shadow.

In view of the above, it would be desirable for roofers to have an inexpensive, rugged, easily and quickly used guide tool for guiding the installation of ridge covers according to the Freiborg or Pressutti teachings. Such a guide tool likely could be used to install other types of ridge covers in which uniformity of relative spacing is important for appearance or other reasons.

SUMMARY OF THE INVENTION

In view of the above, an object for the present invention is to provide an inexpensive, rugged, easily and quickly used guide tool for guiding the installation of ridge covers.

Another object for this invention is to provide a method of installing such ridge covers using such a guide tool, which method results in proper and uniform placement of the ridge covers relative to one anther, and a resulting uniformity of shadow lines by the individual ridge covers on their neighboring ridge covers.

Accordingly, the present invention provides a guide tool for use in installing ridge covers. This guide tool includes a guide tool for use in installing ridge covers successively on a roof along an intersection of planar surfaces of the roof at which these surfaces define an exterior angle. The guide tool includes a pair of elongate planar wings intersecting along a respective line of intersection and being angularly spaced apart to define an exterior angle substantially matching the exterior angle of the roof. A pair of first projections on an underside of the guide tool each on a respective one of the pair of wings are aligned perpendicularly to the line of intersection. A pair of second projections on an upper side of the guide tool each on a respective one of the pair of wings are aligned perpendicularly to the line of intersection, and the second projections are spaced along the line of intersection a selected distance from the first projections. A handle is included on the guide tool for allowing manual purchase on the guide tool. Thus, with the guide tool nested atop an installed ridge cover, engagement of the first projections with this installed ridge cover relatively positions the guide tool along the line of intersection, and a next-successive ridge cover to be installed is laid atop the guide tool with an end edge of this ridge cover in engagement with the second projection during nailing of the overlying ridge cover to the roof. In other words, the guide tool is sandwiched between ridge covers during nailing of the top ridge cover to the roof. Next, the handle allows the tool to be grasp and pulled from under the overlying ridge cover. In this way, the end edge of the overlying ridge cover is selectively spaced in overhanging relation to the previously installed ridge cover to provide a shadow line on the roof.

According to an additional aspect, the present invention provides a method of installing ridge covers successively on a roof along a ridge, hip, or rake at which intersecting planar surfaces of the roof cooperatively define a line of intersection having an exterior angle, the method comprising steps of: securing a first ridge cover at the line of intersection on the roof; providing a guide tool having a pair of elongate planar wings intersecting along a respective line of intersection and cooperatively defining an exterior angle substantially matching that of the roof, providing the guide tool with a pair of reference surfaces, one of the pair of reference surfaces being disposed on an upper side of the guide tool while the other of the pair of reference surfaces is spaced from the one reference surface along the line of intersection and is disposed on an underside of the guide tool; nesting the guide tool atop the first ridge cover; moving the guide tool along the line of intersection to engaging the other reference surface with the installed ridge cover; placing a next-successive ridge cover atop the guide tool with an end edge thereof in engagement with the one reference surface, and securing the next-successive ridge cover on the roof; and sliding the guide tool from under the next-successive ridge cover.

An advantage of the present invention results from its providing a pair of spaced apart opposite reference surfaces, one of which is engageable with an installed ridge cover, and the other of which is engaged by a ridge cover to be nailed to position this ridge cover during nailing. Because the spacing between the reference surfaces is constant, the relative positioning of ridge covers on a roof is nearly constant as well. Relative position accuracy and repeatability for ridge covers installed using the present guide tool are on the order of about 1/32 inch or less. Consequently, the shadow line provided by the ridge covers as installed is almost perfectly uniform along a ridge, hip, or rake of the roof, and the appearance of the roof is improved.

An additional advantage results from the method of installing ridge covers using the present guide tool, and in which use of the tool results in much better relative positional accuracy of the ridge covers than can be achieved with conventional installation methods, and resulting better uniformity of the shadow lines cast by the ridge cover, with resulting better appearance for a roof having ridge covers installed in such a way.

Additional objects and advantages may be appreciated from a reading of the following detailed description of a two alternative exemplary and preferred embodiments of the guide tool invention taken in conjunction with a description of the method of installing ridge covers using one of these tools, and the following drawing Figures, in which like features or features analogous in structure or function are referenced with the same reference numeral throughout the several views:

DESCRIPTION OF THE DRAWING FIGURES

FIG. 1 provides a perspective view of a roof having intersecting planar sections at which ridge covers according to the Freiborg or Pressutti teaching are installed;

FIG. 2 provides an enlarged perspective view of a portion of the roof seen in FIG. 1, but is shown during the installation of ridge covers using a guide tool and method according to the present invention, and also provides an upper perspective view of this guide tool;

FIGS. 3 is an under-side perspective view of the guide tool seen in FIG. 2;

FIG. 4 provides a fragmentary side elevation view of ridge covers and the guide tool during installation of the ridge covers on a roof;

FIGS. 5 and 6 are respective perspective views taken respectively from the under-side and from the upper side of a guide tool embodying an alternative embodiment of the present invention;

FIG. 7 is an end elevation view of the angular adjustment mechanism of the embodiment of the tool seen in FIGS. 5 and 6.

DESCRIPTION OF PREFERRED EXEMPLARY EMBODIMENTS OF THE INVENTION

Figure 1:
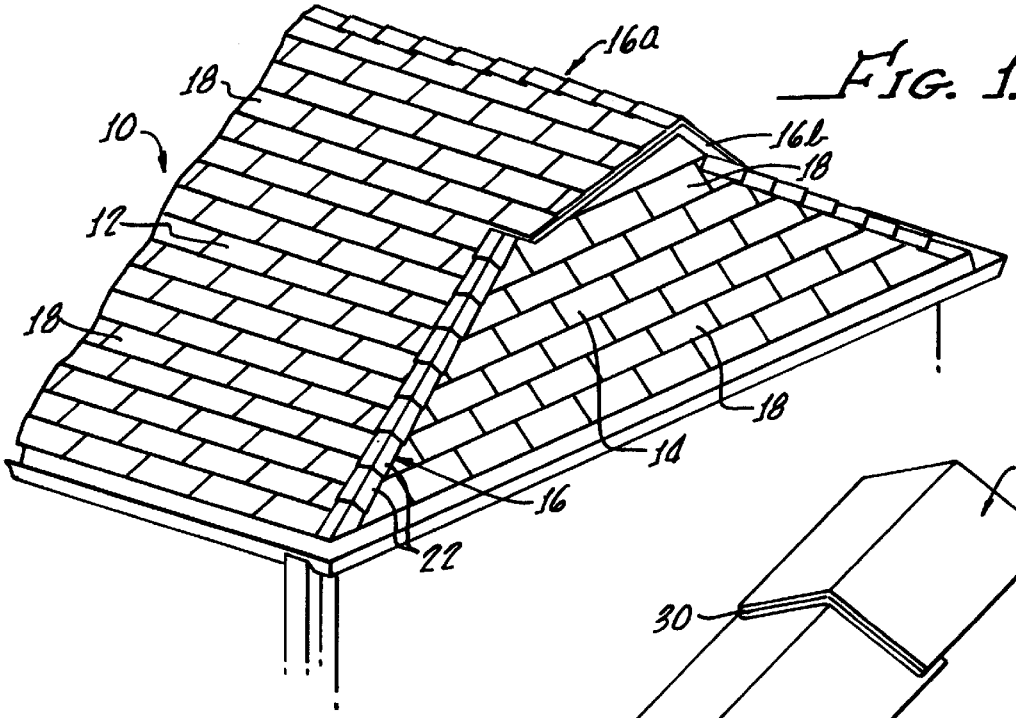
Figure 2:
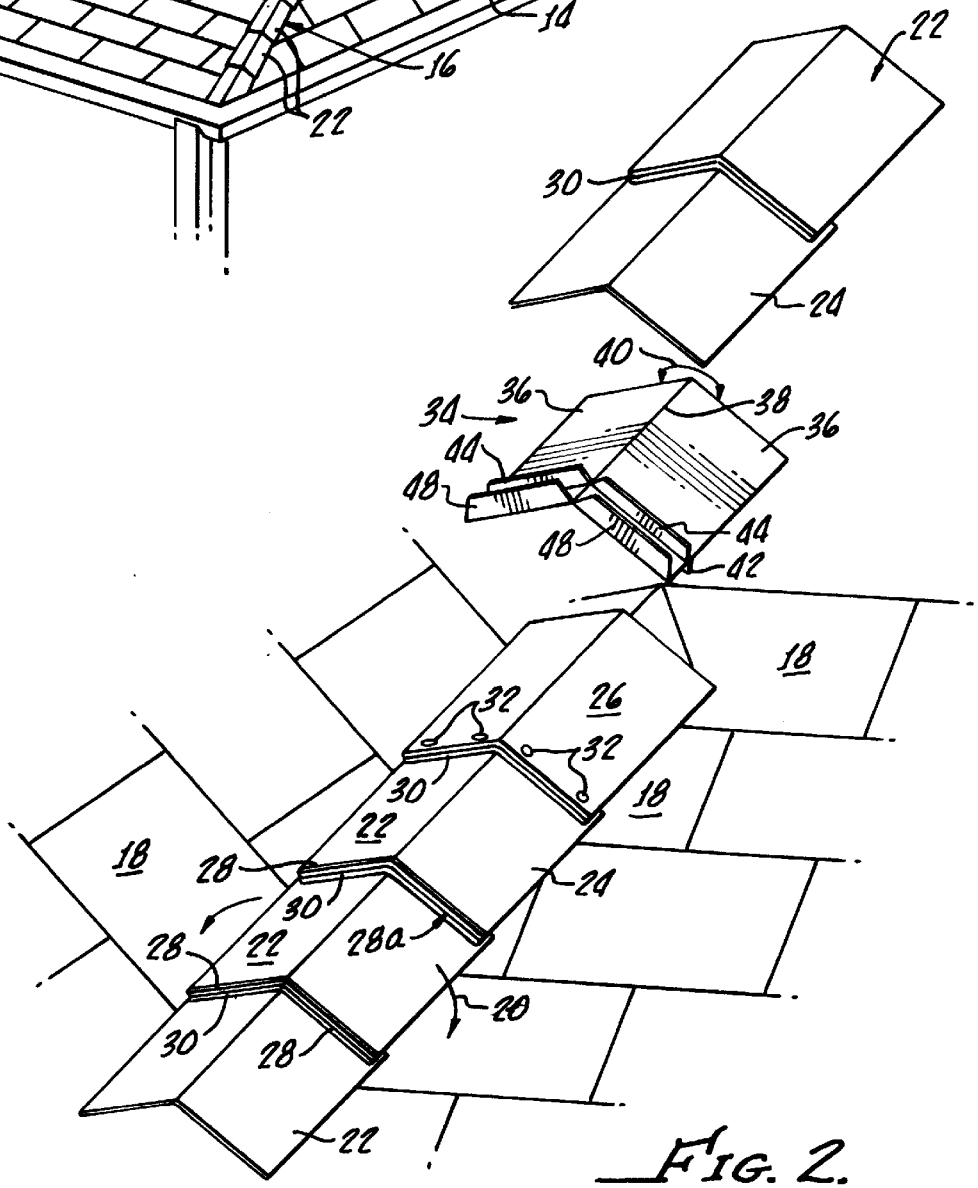

First referring to FIGS. 1 and 2 in conjunction, a roof 10 has planar surfaces 12 and 14, which intersect at a hip, ridge, or rake 16. In this case, the surfaces 12 and 14 intersect at a sloping line 16, and this would be termed a hip. It will be understood that the roof has other planar surfaces which intersect at other lines. For example, a portion of the horizontal ridge 16*a* of the roof 10 is illustrated. Also, a rake 16*b* is illustrated above a gable of the roof. In this case, ridge covers are not installed on the rake 16*b*, although some roof styles use ridge covers or shingles on such rakes. The planar surfaces 12 and 14 are covered with field shingles 18, and intersect to define an exterior angle, indicated with the arrowed numeral 20 in FIG. 2.

In FIG. 1, the hip 16 is covered with ridge covers 22, while in FIG. 2, hip 16 is shown during the installation of these ridge covers 22. As is seen in FIG. 2, the installer has applied several of the ridge covers 22, beginning at the lower end of the hip 16 (i.e., at the eaves and overhang of the roof 10), and working progressively up the slope of the roof 10. As each ridge cover 22 is installed, its lower portion 24 covers the upper portion 26 of the next preceding ridge cover 22. This lower portion 24 of each ridge cover further projects past or overlaps at its end edge 28 (in this case, a lower end edge, although this edge 28 would not be lower along a horizontal ridge) slightly below the thickened central portion 30 of the preceding ridge cover. Thus, recalling the explanation above, and depending upon the direction of ambient light, the thickened portion 30 will be partially or entirely in a shadow (i.e., a shadow line) created by the overhang of edge 28 beyond portion 30. This shadow line is indicated with the numeral 28*a* in FIG. 2. The ridge cover 22 is nailed through the thickened portion 30 into the underlying roof structure (as indicated by nail heads 32 seen near the upper extent of FIG. 2).

Figure 3:
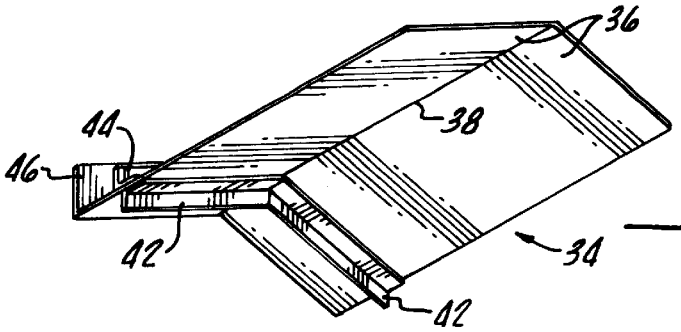

Consequently, at is seen in FIG. 2 and 3, each ridge cover 22 defines a shadow line 28*a* across the lower portion 24 and thickened portion 30 of the preceding ridge cover, dependent upon ambient lighting conditions. The depth of this shadow line 28*a* is important in obtaining a pleasing appearance for the roof 10, as has been explained. An important aspect of this pleasing appearance for the roof 10 is the uniformity of the shadow line depth in the view of an observer at a distance from the roof. This observer will have a view of a large part of a ridge, hip, or rake (unlike the installer on the roof), and will be able to visually detect any significant lack of uniformity for the shadow lines 28*a*.

Figure 4:
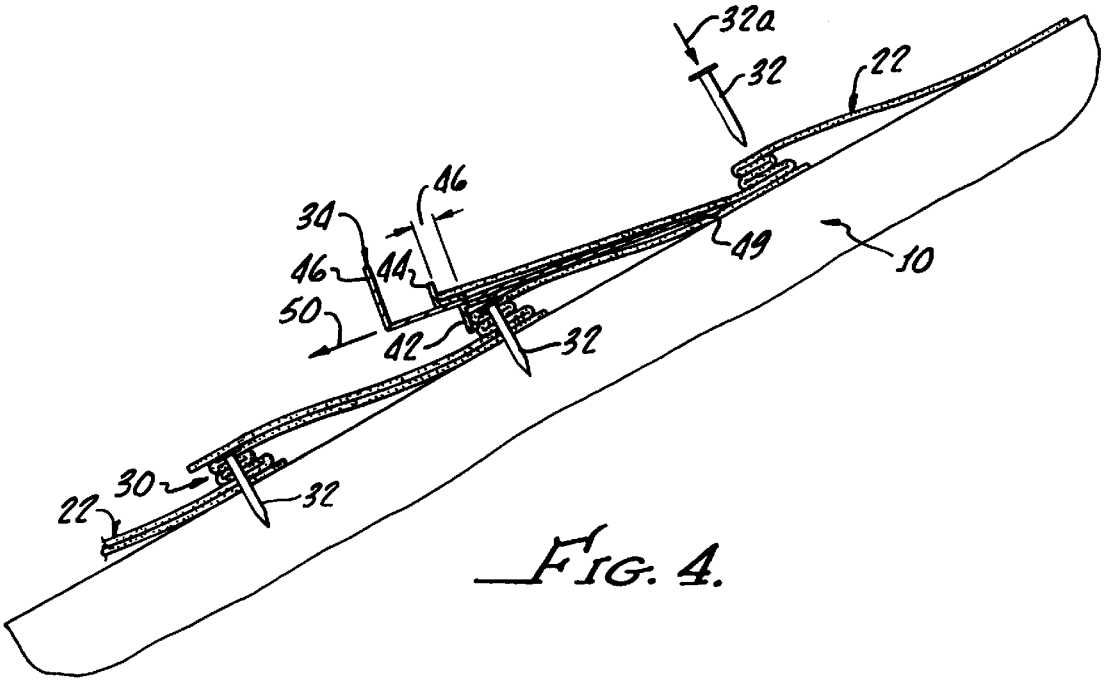

Viewing now FIGS. 2, 3, and 4 in conjunction with one another, a guide tool 34 for use uniformly and precisely installing the ridge covers 22 in a selected relative position is shown in perspective and cross sectional views. By the use of this tool 34, a precise and repeated depth of shadow line 28*a* will be obtained between each adjacent pair of ridge covers. This tool 34 has a pair of elongate planar wings 36, which intersect along a line 38 and are angularly spaced apart to define an exterior angle 40 substantially matching the exterior angle 20 of the roof surfaces 12 and 14 at intersection hip 16. Preferably, the wings 36 are formed of sheet metal, although this need not be the case. On its underside, viewing FIG. 3, the tool 34 includes a pair of elongate flat projections 42 which are in alignment with one another and which extend perpendicularly to the line of intersection 38. In this embodiment of the guide tool 34, the projections 42 are formed by respective legs of L-shaped sheet metal members aligning with one another, and each having its other leg spot welded to the respective wing 36 of the tool. On its upper side, viewing primarily FIG. 2, the tool 34 also includes a pair of elongate flat projections 44, which are also in alignment with one another and extend perpendicularly to the intersection line 38. In this embodiment of the guide tool 34, the projections 44 are also formed by respective legs of L-shaped sheet metal members each having its other leg spot welded to the respective wing 36.

FIG. 4 shows that in side elevation view the projections 42 and 44 are offset along the length of tool 34 by a distance indicated with the numeral 46. Spaced from the projections 44, the tool 34 includes an upturned handle flange portion, generally indicated with the numeral 48. In this case, the handle flange portion 48 is simply formed by an upturned marginal portion of each of the wings 36.

In the use of the tool 34 as seen in FIGS. 2 and 4, the installer places the tool 34 atop an installed ridge cover 22, and presses it upwardly along the line of the intersection 16 of the roof surfaces so that projections 42 each engage against the thickened portion 30 of the installed ridge cover. While holding the guide tool 34 in this position, the installer places the next ridge cover 22 atop the tool so that the end edge 28 abuts against the projections 44. This places the end edge 28 past the thickened portion 30 by a distance equal to the offset 46 as seen in FIG. 4, which will be the dimension of the shadow line 28*a* achieved at each ridge cover 22, as can be appreciated. The top ridge cover is nailed in place in this relative position, as is indicated by the nail 32 and arrow 32*a* seen in FIG. 4. It will be noted that an end edge 49 of the tool 34 extends toward but short of the thickened portion 30 of the overlying ridge cover, so that nails passing though this thickened portion miss the tool 34. The offset 46 extends from the alignment of projections 42 away from the end edge 49. Next, the installer slides the guide tool 34 out from under the installed ridge cover 22 just installed and nailed along the direction indicated by arrow 50 in FIG. 4 (i.e., in the plane of the wings 36 and parallel to intersection line 38), using the handle flange 48 to gain purchase on the tool. This process is repeated with each ridge cover installed along the ridges, hips, and rakes of the roof.

It will be appreciated that with the tool seen in FIGS. 2, 3, and 4, the exterior angle 40 of the tool must be made to substantially match the angle 20 at each ridge, hip, or rake of a roof. Because this exterior angle varies with each roof and each intersection of the planar portions of each roof, a variety of the tools 34 may be made with a corresponding variety of angles between wings 36. Alternatively, the tools may be bent at intersection line 38 to fit these exterior angles. This bending of the tools for each section of a roof is especially possible and easy if the tools are fabricated from malleable sheet metal. Still alternatively, a hinged adjustable tool structure may be provided. Turning now to FIGS. 5, 6, 7, and 8, a guide tool according to an alternative embodiment of the invention is depicted. This alternative embodiment provides such a hinged adjustable guide tool structure. In order to obtain reference numerals for use in describing this alternative adjustable tool, features which are the same or analogous in structure or function to those described above are referenced with the same numeral used above, and increased by one-hundred (100). Thus, the guide tool seen in FIGS. 5–8 is referenced with numeral 134. The use of this tool 134 by an installer of ridge covers is exactly as described above once the tool is adjusted to match the exterior angle of intersecting planar portions of a roof. Adjustment of the tool will be self-evident in view of the following description of the structure of the tool 134. Tool 134 is preferably formed of sheet metal as will be described. However, it will be appreciated that other materials of construction can be used for tool 134. For example, it will be apparent that the tool 134 could be made using one of the modern engineering thermoplastics which have adequate physical properties for this use.

FIGS. 5 and 6 show that the projections 142 and 144 are in this case formed by respective tabs each punched free at three of four edges from the wings 134 and bent at the attached forth edge to extend substantially perpendicularly to these wings. The projections 142 and 144 are aligned with one another in pairs on respective lines perpendicular to the intersection line 138, and are offset by a dimension 146 along the line 138, consistent with the explanation given above and as seen in FIG. 6. However, in contrast to the essentially non-adjustable tool described above, the guide tool 134 includes plural integral hinge knuckles 52, each formed by a rolled extension portion 52*a* (seen in FIG. 8) integral with the respective wing 134. These hinge knuckles 52 interdigitate as is seen in the drawing Figures, and are hingeably linked by a hinge pin 54. The thickness of the resulting hinge structure is not enough to interfere with installation of ridge cover, but does allow the exterior angle defined by the wings 134 to be adjusted, as is easily understood. It will be appreciated that the hingeable attachment of wings 136 to one another may be achieved by using a separate hinge or hinges installed to the wings 136 along the intersection line 138. Such a separate hinge or hinges may simply be spot welded to the wings 136 if these wings are made of sheet metal. In the case of a guide tool made of plastic, it is within the skill of the art to provide an integral living hinge section (not shown) between such guide tool wings.

In order to allow the exterior angle to be adjusted and retained, the guide tool 134 includes a pair of overlapped arcuate portions 56, each defining an arcuate slot 58. These portions 56 overlap as is seen in FIGS. 5, 6, and 7, and scissor past one another in close relationship with the slots 58 at least partially aligned so that a carriage bolt 60, washer 62, and wing nut 64 can be used to cinch the portions 56 into a fixed relative position. Of course loosening the wing nut 64 allows the installer to lay the guide tool atop the roof at the intersection of surfaces 12 and 14 (i.e., atop intersection 16—whether a ridge, hip, or rake) so that the exterior angle of the tool matches that of the roof, and that of the ridge covers to be installed. The portions 56 together serve as handle flange 48 did in the earlier embodiment to allow the installer to grasp the tool and slide it out from under an installed ridge cover, recalling the explanation above of how the ridge covers are installed using the tool 34.

Figure 8:
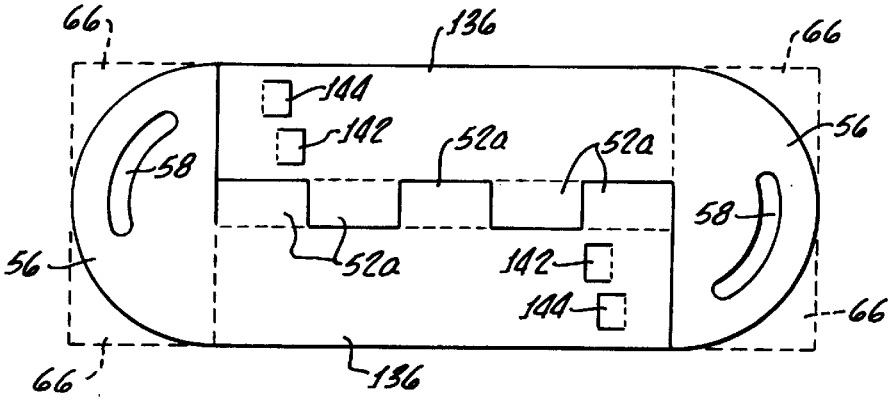
FIG. 8 depicts a pattern for use in stamping work pieces from a single piece of metal sheet preparatory to making the guide tool shown in FIGS. 5–7.

FIG. 8 illustrates how a tool 134 may be economically made by punching and stamping (i.e., using a punch press) forming both wings 136, and both arcuate portions 56, along with the hinge knuckles 52 from a single rectangular piece of sheet metal, with very little wasted metal stock. As is illustrated by the dashed lines, corner portions 66 are removed as part of the punching operations to form the outlines of the arcuate portions 56. The work pieces are also cut during this punching operation at each interior solid line and bent out of plane at each dashed line as seen in FIG. 8 to provide the two wings 136 of the tool 134 with projections 142, 144, and arcuate portions 56 with slots. The knuckle portions 52*a* are rolled to form knuckles 52 and allow them to be interdigitated. Hinge pin 54 is then introduced to hingeably couple the two wings 136. Because of the complementary form of the arcuate portions 56, these portions overly one another with slots 58 aligned at least in part. The tool 134 is completed by addition of carriage bolt 60, washer 62, and wing nut 64.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. Thus, the depicted and described preferred embodiments of the invention are exemplary only, and are not exhaustive of the scope of the invention. Consequently, the invention is intended to be limited only by the spirit and scope of the appended claims, giving full cognizance to equivalents in all respects.

I claim:

1. A guide tool for use in installing ridge covers successively on a roof along an intersection of planar surfaces of the roof at which these surfaces define an exterior angle, said guide tool comprising:

a pair of elongate planar wings intersecting along a respective line of intersection and being angularly spaced apart to define an exterior angle substantially matching the exterior angle of the roof;

a pair of first projections on an underside of said guide tool each on a respective one of said pair of wings and aligned perpendicularly to said line of intersection;

a pair of second projections on an upper side of said guide tool each on a respective one of said pair of wings and aligned perpendicularly to said line of intersection, and said second projections being spaced along said line of intersection a selected distance from said first projections;

handle means for allowing manual purchase on said guide tool;

whereby, with said guide tool nested atop an installed ridge cover, engagement of the first projections with this installed ridge cover relatively positions the guide tool along the line of intersection, and a next-successive ridge cover to be installed is laid atop the guide tool with an end edge thereof in engagement with the second projection during nailing to the roof, the handle means allowing the tool to be grasp and pulled from under the next-successive ridge cover after nailing, so that the end edge of the next-successive ridge cover is selectively spaced in overhanging relation to the previously installed ridge cover to provide a shadow line on the roof.

2. The guide tool of claim 1 wherein said first projections are defined by a pair of L-shaped members, each of said L-shaped members having a respective leg thereof secured to a respective one of said pair of wings.

3. The guide tool of claim 1 wherein said second projections are defined by a pair of L-shaped members, each of said L-shaped members having a respective leg thereof secured to a respective one of said pair of wings.

4. The guide tool of claim 1 wherein said handle means includes a marginal end portion of each of said pair of wings, which marginal portion is bent substantially 90 degrees out of the plane of the respective one of said pair of wings to provide a surface for manual purchase and application of pulling force along the plane of said pair of wings.

5. The guide tool of claim 1 wherein said pair of wings are integral with one another.

6. The guide tool of claim 1 further including hinge means for hingeably connecting said pair of wings adjustably to one another, and means for adjusting and retaining said pair of wings in a selected exterior angle for said guide tool.

7. The guide tool of claim 6 wherein said hinge means includes each of said pair of wings defining a respective one of a pair of hinge knuckles, said pair of hinge knuckles interdigitating with one another to receive a hinge pin.

8. The guide tool of claim 6 wherein said means for adjusting and retaining said pair of wings in a selected exterior angle for said guide tool comprises each of said pair of wings including a respective one of a pair of planar portion each overlapping with the corresponding planar portion of the other of said pair of wings, and means for releasably engaging said pair of planar portions in a fixed relative position to hold said pair of wings in a selected exterior angle for said guide tool.

9. The guide tool of claim 8 in which said means for releasably engaging said pair of planar portion in a fixed relative position includes each of said pair of planar portions defining a respective one of a pair of slots, and a fastener received in said pair of slots and cinching said pair of planar portions into engagement with one another.

10. A guide tool for use in installing ridge covers successively on a roof along an intersection of planar surfaces of the roof at which these surfaces cooperatively define an exterior angle, said guide tool comprising:

a pair of elongate planar wings, means hingeably connecting said pair of wings to intersect along a respective line of intersection to cooperatively define an exterior angle;

a pair of first projections on an underside of said guide tool each on a respective one of said pair of wings and aligned perpendicularly to said line of intersection;

a pair of second projections on an upper side of said guide tool each on a respective one of said pair of wings and aligned perpendicularly to said line of intersection, and said second projections being spaced along said line of intersection a selected distance from said first projections;

means for allowing manual purchase on said guide tool so that said guide tool may be slid from under an installed ridge cover parallel to said line of intersection;

means for releasably retaining said pair of wings in a selected exterior angle so that the exterior angle of said guide tool substantially matches that of said roof, and said guide tool may nest atop said intersection of the planar surfaces of said roof.

11. The guide tool of claim 10 wherein said means for hingeably connecting said pair of wings includes each of said pair of wings defining a respective one of a pair of hinge knuckles, said pair of hinge knuckles interdigitating with one another to receive a hinge pin.

12. The guide tool of claim 10 wherein said means for allowing manual purchase on said guide tool, and said means for releasably retaining said pair of wings in a selected exterior angle includes each of said pair of wings including a respective one of a pair of planar portion each overlapping with the corresponding planar portion of the other of said pair of wings, and means for releasably engaging said pair of planar portions in a fixed relative position to hold said pair of wings in a selected exterior angle for said guide tool, said planar portions cooperatively providing a surface which may be manually grasp to apply pulling force to said guide tool along said line of intersection.

13. The guide tool of claim 12 in which said means for releasably engaging said pair of planar portion in a fixed relative position includes each of said pair of planar portions defining a respective one of a pair of slots, and a fastener received in said pair of slots and cinching said pair of planar portions into engagement with one another.

14. A method of installing ridge covers successively on a roof along a ridge, hip, or rake at which intersecting planar surfaces of the roof cooperatively define a line of intersection having an exterior angle, said method comprising steps of:

securing a first ridge cover at said line of intersection on said roof;

providing a guide tool having a pair of elongate planar wings intersecting along a respective line of intersection and cooperatively defining an exterior angle substantially matching that of the roof, providing the guide tool with a pair of reference surfaces, one of said pair of reference surfaces being disposed on an upper side of said guide tool while the other of said pair of reference surfaces is spaced from said one reference surface along said line of intersection and is disposed on an underside of said guide tool;

nesting said guide tool atop the first ridge cover;

moving the guide tool along the line of intersection to engaging said other reference surface with the installed ridge cover;

placing a next-successive ridge cover atop the guide tool with an end edge thereof in engagement with said one reference surface, and securing the next-successive ridge cover on the roof; and sliding the guide tool from under the next-successive ridge cover.

* * * * *